US005291632A

United States Patent [19]

Akashi

[11] Patent Number: 5,291,632

[45] Date of Patent: Mar. 8, 1994

[54] HANGER DEVICE

[75] Inventor: Shunji Akashi, Kurobe, Japan

[73] Assignee: Yoshida Kogyo K. K., Tokyo, Japan

[21] Appl. No.: 951,847

[22] Filed: Sep. 28, 1992

[30] Foreign Application Priority Data

Sep. 27, 1991 [JP] Japan ..... 3-087081[U]

[51] Int. Cl.[5] ..... E05D 15/00; A47H 13/00

[52] U.S. Cl. ..... 16/87.002; 16/87.008

[58] Field of Search ..... 16/87.2, 87.8, 87.4 R, 16/87.6 R; 24/601.5, 716

[56] References Cited

U.S. PATENT DOCUMENTS 3,596,306 8/1971 Wachenheimer ..... 16/87.2

FOREIGN PATENT DOCUMENTS 185530 5/1956 Austria ..... 16/87.8

1147430 4/1963 Fed. Rep. of Germany ..... 16/87.2

2306670 2/1974 Fed. Rep. of Germany .

2613740 6/1977 Fed. Rep. of Germany .

2290872 11/1976 France .

2360740 3/1978 France .

*Primary Examiner*—John Sipos

*Assistant Examiner*—Carmine Cuda

*Attorney, Agent, or Firm*—Hill, Steadman & Simpson

[57] ABSTRACT

A hanger device for hanging a curtain to a curtain rod via a curtain runner reciprocally mounted on the curtain rod. The hanger device comprises a hanger body attached to the curtain and a hook portion pivotally mounted on the hanger body and adapted for hooking engagement with a curtain runner. When the hook portion is angularly moved to an inclined position, the hook portion is locked to the hanger body against unnecessary oscillation, so that the hook portion is quite immune from be entangled with the curtain during laundering of the curtain.

3 Claims, 7 Drawing Sheets

HANGER DEVICE

BACKGROUND OF THE INVENTION

1. Field of the Invention

The present invention relates to a hanger device used for hanging a curtain to curtain runners reciprocally mounted on a curtain rod or curtain rail.

2. Description of the Related Act

A typical example of this hanger device of the type concerned is described in Japanese Utility Model Application No. 2-95740 filed on Sep. 11, 1990. This conventional hanger device comprises a hanger body attached to a curtain and a hook portion pivotally mounted on the hanger body and adapted for catching engagement with a curtain runner reciprocally mounded on a curtain rod. This conventional hanger device suffers the following disadvantages. When the curtain is laundered by washing machines, the curtain is subjected to severe stresses exerted by violent water whirlpool. During the laundering, the hook portions of the hanger devices are apt to freely oscillate relative to the hanger bodies and hence the curtain as a whole. Consequently, the hook portions of the hanger devices are prone to be heavily entangled with the fabric system of the curtain. Once the hook portions are heavily entangled with the system of the curtain, it is time-consuming and tedious to untangle the hook portions from the curtain. Forcible release of the hook portions from the curtain could fatally damage the curtain as a whole.

If the curtain is made of a netting or openwork fabric such as lace, the problem is much worse. Since the hook portions pierce through coarse networks of the curtain lace over several layers, it is close to impossible to untangle hook portions from the curtain without permanently breaking the curtain.

SUMMARY OF THE INVENTION

With the foregoing difficulties in view, it is therefor an object of the present invention to provide a hanger device which is quite immune from getting entangled with and damaging a fabric piece of a curtain when the curtain is laundered.

According to the present invention, there is provided A hanger device for hanging a curtain to a curtain rod via a curtain runner reciprocally mounted on the curtain rod, the hanger device comprising a hanger body attached to the curtain, a hook portion pivotally mounted on the hanger body and adapted for hooking engagement with a curtain runner and means for locking the hook portion to the hanger body when the hook portion is angularly moved to an inclined position.

Many other advantages and features of the present invention will become manifest to those versed in the art upon making reference to the detail description and the accompanying sheets of drawings in which preferred structural embodiments incorporating the principles of the present invention are shown by way of illustrative example.

DETAILED DESCRIPTION

Figure 1:
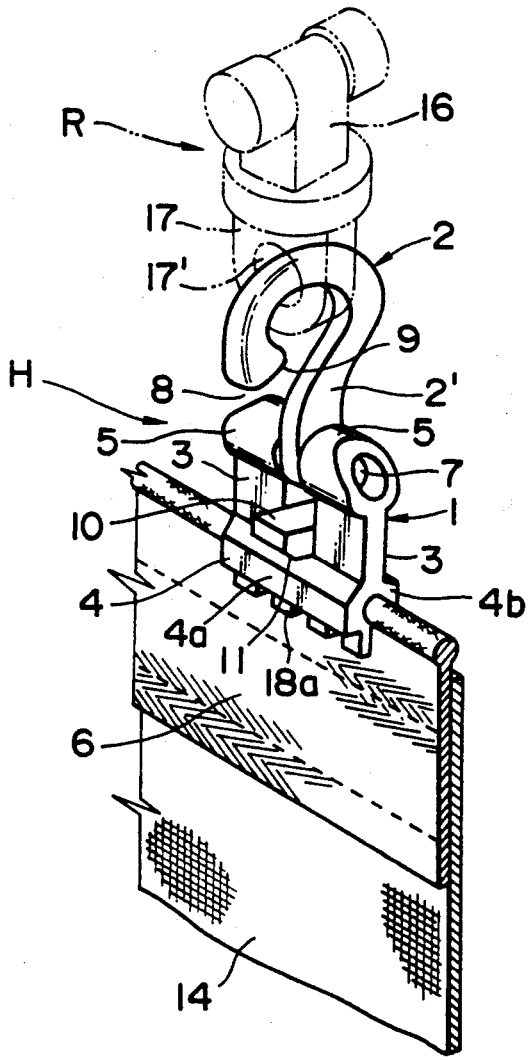
FIG. 1 is a fragmentary perspective view showing a hanger device according to the first embodiment of the present invention attached to a curtain and hooked to a curtain runner shown in phantom lines.
Figure 2:
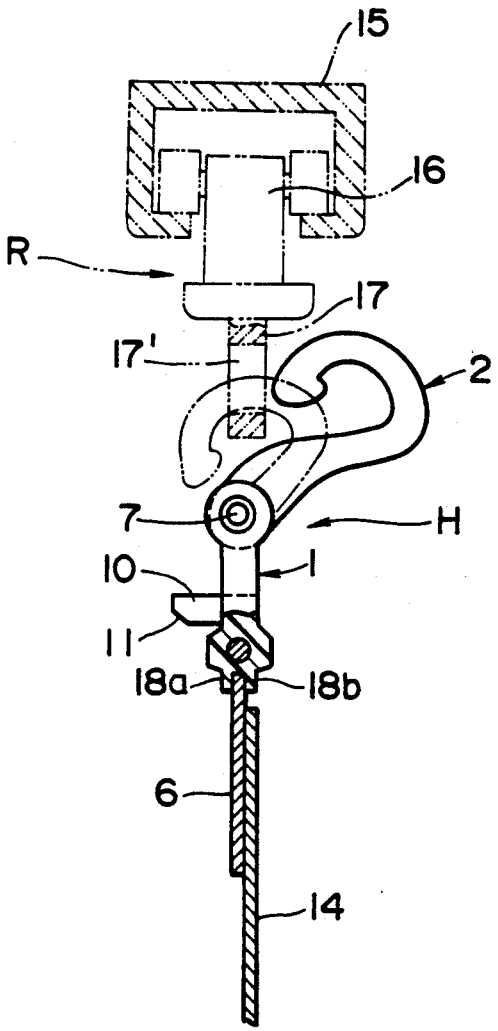
FIG. 2 is a side view, partly cutaway, of the hanger device and the associate parts shown in FIG. 1, a curtain rod being shown in phantom lines.
Figure 3:
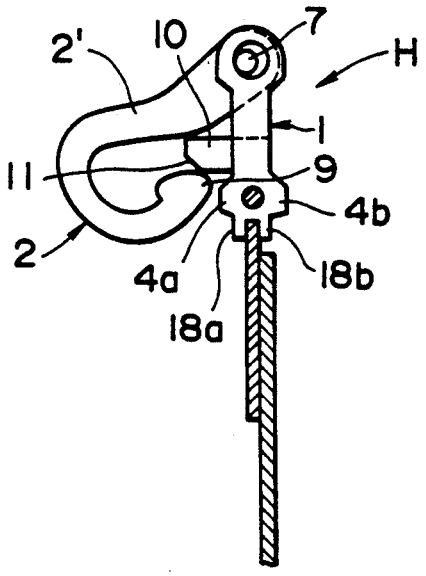
FIG. 3 is a side view, partly cutaway, of the hanger device of FIG. 1 but showing a hook portion locked to a hanger body.

FIGS. 1 through 3 show a first embodiment of the present invention. As better shown in FIG. 2, a hanger device H according to the present invention is intended for hanging a curtain 14 to a curtain rod 15 via a curtain runner R reciprocally mounted on the curtain rod 15. As better shown in FIG. 1, the hanger device H broadly comprises a substantially rectangular hanger body 1 attached to the curtain 14 via an attachment tape 6 and a hook portion 2 pivotally mounted on the upper portion of the hanger body 1; the hanger body I and the hook portion 2 being separate but each being made of synthetic resin.

The hanger body 1 comprises a thickened base 4 having a U-shaped cross-section and mounted on an upper marginal edge of the elongated marginal attachment tape 6, a pair of juxtaposed flanges 3, 3 extending from the top and disposed on the opposite ends of the thickened base 4, and a pair of coaxial sleeves 5,5 mounted on the tops of the respective flanges 3, 3, the sleeves 5, 5 extending longitudinally of the attachment tape 6. The thickened base 4 is mounted astraddle of the longitudinal marginal edge of the tape 6 with one leg 4*a*, 4*b* on either side of the tape 6.

The hanger body 1 is molded, by injection molding process, integrally astraddle the edge of the attachment tape 6.

Preferably, the hanger body 1 may further include a plurality of (four illustrated in the drawings) linking fingers 18*a*, 18*b* extending downward from the lower edge of each leg 4*a*, 4*b* and arranged in a row and in registry with the corresponding linking fingers 18*b*, 18*a* of the other leg 4*b*, 4*a*, respectively. And, the linking fingers 18*a*, 18*b* of the respective legs 4*a*, 4*b* are integrally welded to each other through the tape 6 during the injection molding. This advantageously causes increased bond of the hanger body 1 to the attachment tape 6.

The hook portion 2 has a pivotal shaft 7 provided on its bottom. The pivotal shaft 7 extend perpendicular to and in opposite directions from the hook portion 2. The pivotal shaft 7 is fitted into the coaxial sleeves 5 so that the hook portion 2 is pivotally mounted on the hook body 1. Alternatively, the hanger body 1 may have a pair of coaxial pins mounted on the tops of the flanges 3, 3 and the hook portions 2 has a pair of coaxial sleeves mounted on the opposite sides therefor for pivotal engagement with the coaxial pins of the hanger body 1.

As shown in FIG. 1, the hook portion 2 is bent backward to cause a distal end 9 thereof to define a gap 8 with a stem 2' of the hook portion 2.

As shown in FIG. 1, the hanger body 1 further includes a locking lug 10 provided on the middle of the thickened base 4 and interposed between the opposed flanges 3, 3. The locking lug 10 projects in such a direction to be able to lock the distal end 9 of the hook portion 1 when the hook portion 2 assumes a inclined position as shown in FIG. 3. The protuberant locking lug 10 has a chamfer 11 on its lower corner for facilitate locking engagement with the distal end 9 of the hook portion 2 when the hook portion 2 is angularly moved to an inclined position.

As shown in FIG. 2, the curtain runner R includes a runner body 16 reciprocally mounted on the curtain rod 15 and a ring portion 17 mounted on the bottom of the runner body 16 so as to be capable of swiveling thereon, the ring portion 17 has a through hole 17' for receiving the hook portion 2 therein.

A plurality of the hanger devices H described above are attached at uniform intervals longitudinally to the attachment tape 6. As better shown in FIG. 1, the attachment tape 6 is secured to and along the upper edge of the curtain 14 by means of sewing. Subsequently, as better shown in FIG. 2, the curtain 14 is hung on the curtain runners 16 reciprocally mounted on the curtain rod 15 by fitting each hook portion 2 into the through hole 17' of the ring portion 17 of a corresponding curtain runner R. In this instance, the hook portion 2 assumes an upright position, as indicated by phantom lines in FIG. 2.

For laundering the curtain 14, the curtain 14 is removed from the curtain runners R by bringing the hook portions 2 of the hanger device H out of engagement with the ring portion 17 of the curtain runners R and then the hook portion 2 is angularly moved into an inclined position in order to bring the distal end 9 thereof into locking engagement with the protuberant locking lug 10 as shown in FIG. 3. Since the hook portion 2 is locked to the hanger body 1 against unnecessary oscillation, the hook portion 2 is immune from being entangled with the fabric system of the curtain 14 during laundering.

Figure 4:
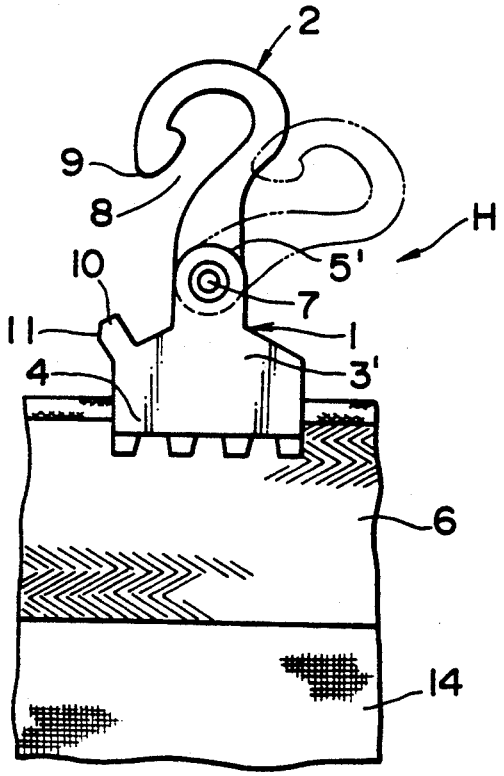
FIG. 4 is a front view of a hanger device according to a second embodiment of the present invention.
Figure 5:
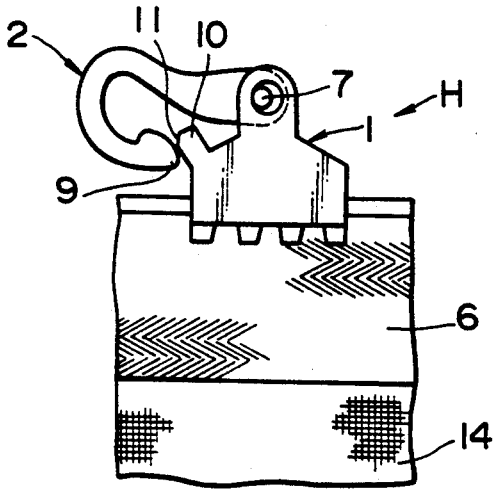
FIG. 5 is also a front view of the hanger device of FIG. 4, but showing a hook portion locked to a hanger body.
Figure 6:
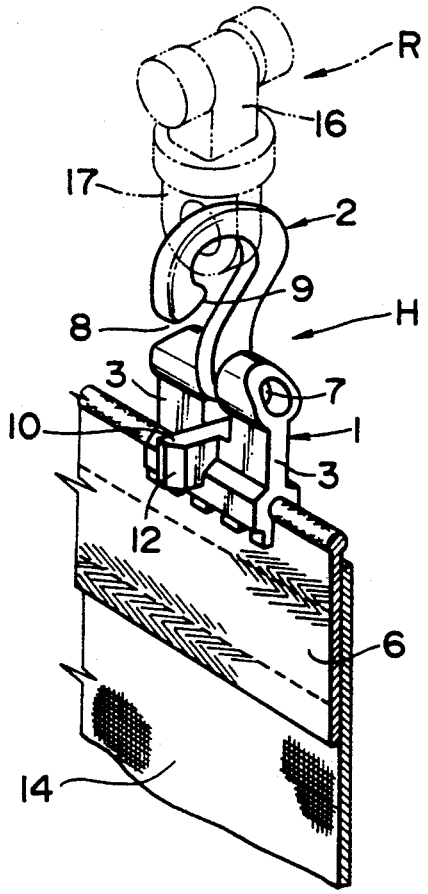
FIG. 6 is a fragmentary perspective view of a hanger device according to a third embodiment of the present, invention.
Figure 7:
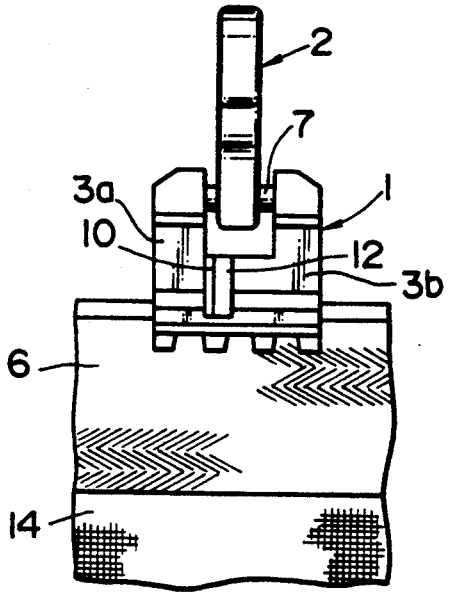
FIG. 7 is a fragmentary front view of the hanger device of FIG. 6.

FIGS. 4 and 5 show a second embodiment of the present invention. Instead of the pairs of flanges, a thickened web 3' is integrally provided on the thickened base 4. A pair of coaxial sleeves 5', 5' are formed on the thickened webs 3, and disposed perpendicularly to the attachment tape 6. Since the coaxial sleeves 5', 5' and hence the pivotal shaft 7 fitted therein extend perpendicularly to the attachment tape 6, the hook portion 2 oscillates along the length of the attachment tape 6. For locking engagement with the hook portion 2, a locking lug 10 is provided on a relevant end of the web 3. Similarly to that of the first embodiment, the protuberant locking lug 10 has a chamfer 11 on its lower corner to facilitate locking engagement with the distal end 9 of the hook portion 2 when the hook portion 2 assume the inclined position, as shown in FIG. 5.

Figure 8:
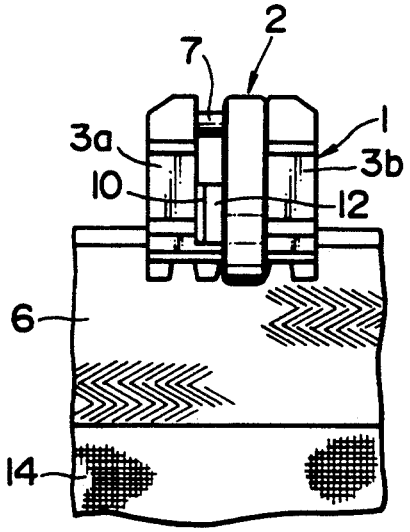
FIG. 8 is a fragmentary front view of the hanger device of FIG. 6 as well, but showing a hook portion locked to a hanger body.
Figure 9:
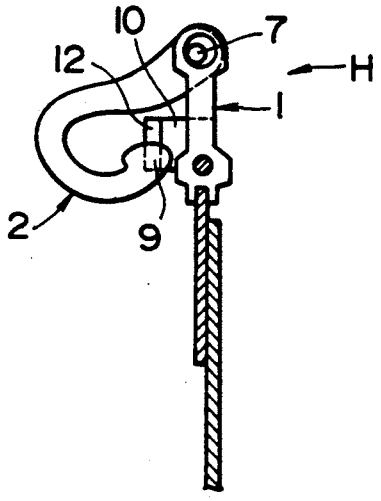
FIG. 9 is a fragmentary side view of the hanger device as shown in FIG. 8.

FIGS. 6 through 9 show a third embodiment of which is substantially identical with the first embodiment. Only one difference resides in the positions of a locking lug 10 and a chamfer 12 formed thereon. As better& shown in FIG. 7, the projecting locking lug 10 is deflected toward one flange 3*a* and has a chamfer 12 formed on one lateral comer remote from said one flange 3*a*. As the hook portion 2 angularly moves counterclockwise as viewed in FIG. 9, the hook portion 2 is swerved rightward progressively by the chamfer 12 as shown in FIG. 8 and causes its distal end 9 come into locking engagement with a relevant side surface of the protuberant locking lug 10, when it comes to assume the inclined position as shown in FIG. 9.

Figure 10:
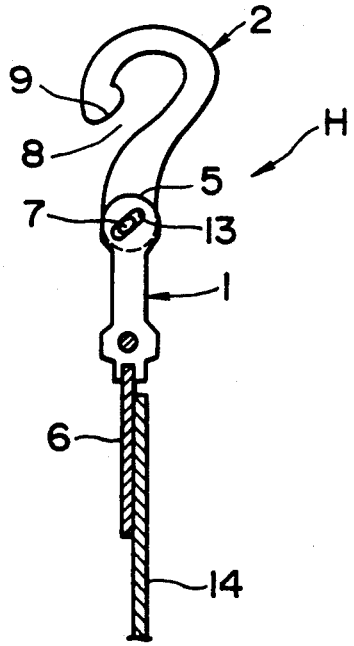
FIG. 10 is a fragmentary side view of a hanger device according to a fourth embodiment of the present invention.
Figure 11:
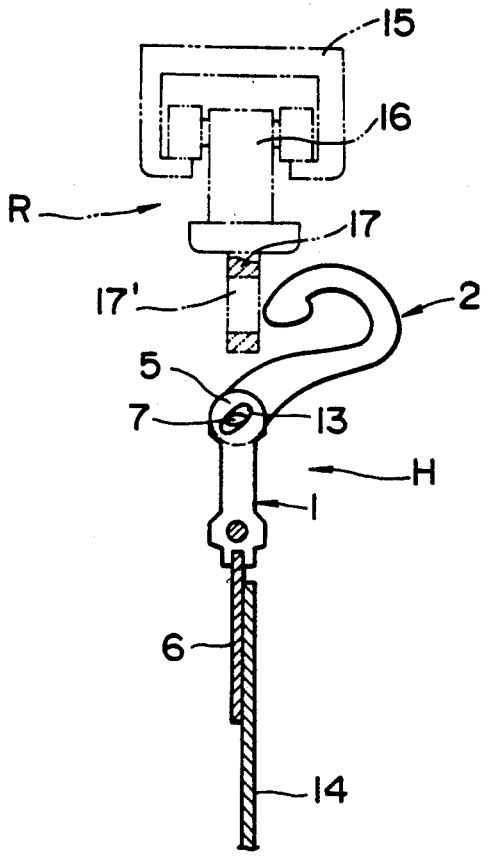
FIG. 11 is a fragmentary side view of the hanger device of FIG. but showing a hook portion inclined somewhat backward.
Figure 12:
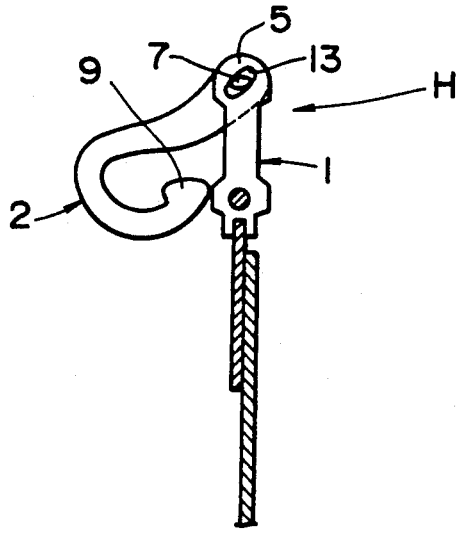
FIG. 12 is a fragmentary side view of the hanger device of FIG. 10 but showing the hook portion locked to a hanger device.

FIGS. 10 through 12 shows a fourth embodiment of the present invention. In this embodiment, there is no protuberant locking lug. Unlike those in the preceding embodiments, a pivotal shaft 7 and holes 13 of sleeves 5 are not circular but oblong in cross-section. It is to be noted that the length of the minor axis of the oblong hole 13 of the sleeves 5 is less than the length of the major axis of the oblong shaft 7. With such a dimensional arrangement, as the hook portion 2 moves angularly counterclockwise as viewed in FIG. 10, the hook portion 2 causes its oblong pivotal shaft 7 come into locking engagement with the oblong holes 13 of the sleeves 5, so that the hook portion 2 comes into locking engagement with the hanger body 1 when it assumes an inclined position, as shown in FIG. 12.

It is to be noted here that, in any of the embodiments set forth hereinabove, when the hook portion 2 comes into locking engagement with the hanger body 1, the distal end 9 of the hook portion 2 is closed by either the locking lug 10 or the hanger body 1 itself (FIG. 12) to ensure that the hook portion 2 is completely immune from catching the fabric system of the curtain 14.

With the construction set forth above, the hanger device according to the present invention will enjoy the following advantages.

Since the hook portion is locked to the hanger body against unnecessary oscillation when its assumes an inclined position, the hook portion of the hanger device is less likely to catch the fabric system of the curtain when the curtain is laundered.

Besides that, if the hook portion is locked to the hanger body with the distal end of the hook portion closed, the hook portion of the hanger device is completely immune from being entangled with the fabric system of the curtain, thus causing no damage upon the curtain even if the curtain is subjected to severe stresses during the laundering.

Obviously, various modifications and variations of the present invention are possible in the light of the above teaching. It is therefore to be understood that within the scope of the appended claims the invention may be practiced otherwise than as specifically described.

What is claimed is:

1. A hanger device for hanging a curtain to a curtain rod via a curtain runner reciprocally mounted on the curtain rod, the hanger device comprising a hanger body attached to the curtain, a hook portion having a stem pivotally mounted on an upper portion of the hanger body about a shaft perpendicular to the stem and a distal end and adapted for hooking engagement with a curtain runner in an upright extended position in use, and means for locking the hook portion to the hanger body such that said distal end is closed by the hanger body when the hook portion is angularly moved to an inclined position.

2. A hanger device according to claim 1, the locking means comprising a proturberant lug mounted on the hanger body and having a chamfer on a distal end thereof, the distal end of the hook portion coming into locking engagement with the protuberant lug when the hook portion assumes the inclined position.

3. A hanger device for hanging a curtain to a curtain rod via a curtain runner reciprocally mounted on the curtain rod, the hanger device comprising a hanger body attached to the curtain, a hook portion pivotally mounted on the hanger body and adapted for hooking engagement with a curtain runner and means for locking the hook portion to the hanger body when the hook portion is angularly moved to an inclined position;

the locking means comprising a pair of coaxial sleeves formed on an upper part of the hanger body and having oblong through holes and a pivotal shaft mounted on the lower part of the hook portion and extending in opposite directions therefrom, the pivotal shaft having an oblong cross section, the pivotal shaft being pivotally fitted into the oblong holes of the coaxial sleeves, the length of the minor axis of the oblong holes of the sleeves being less than the length of the major axis of the pivotal shaft.

* * * * *